US008167094B2

(12) United States Patent
Ueda et al.

(10) Patent No.: US 8,167,094 B2
(45) Date of Patent: May 1, 2012

(54) ELEVATOR APPARATUS

(75) Inventors: Takaharu Ueda, Tokyo (JP); Takehiko Kubota, Tokyo (JP); Akihiro Chida, Tokyo (JP); Satoru Takahashi, Tokyo (JP); Rikio Kondo, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 436 days.

(21) Appl. No.: 12/532,414

(22) PCT Filed: Apr. 26, 2007

(86) PCT No.: PCT/JP2007/059034

§ 371 (c)(1),
(2), (4) Date: Sep. 22, 2009

(87) PCT Pub. No.: WO2008/136114

PCT Pub. Date: Nov. 13, 2008

(65) Prior Publication Data

US 2010/0101896 A1 Apr. 29, 2010

(51) Int. Cl.
*B66B 1/32* (2006.01)

(52) U.S. Cl. ..... 187/288; 187/393

(58) Field of Classification Search ..... 187/247, 187/277, 287, 288, 291–293, 296, 297, 351, 187/391–393
See application file for complete search history.

(56) References Cited

U.S. PATENT DOCUMENTS

| | | | | |
|---|---|---|---|---|
| 4,984,659 | A * | 1/1991 | Nomura | 187/288 |
| 5,153,389 | A | 10/1992 | Nomura | |
| 7,669,697 | B2 * | 3/2010 | Ueda et al. | 187/391 |
| 7,730,998 | B2 * | 6/2010 | Takahashi et al. | 187/288 |
| 7,748,502 | B2 * | 7/2010 | Ueda et al. | 187/293 |
| 7,891,466 | B2 * | 2/2011 | Okamoto et al. | 187/288 |
| 7,918,320 | B2 * | 4/2011 | Kondo et al. | 187/288 |
| 7,938,231 | B2 * | 5/2011 | Ueda et al. | 187/288 |
| 2007/0284196 | A1 | 12/2007 | Sakai et al. | |
| 2009/0133964 | A1 | 5/2009 | Ueda et al. | |
| 2009/0223746 | A1 | 9/2009 | Takahashi et al. | |
| 2009/0229924 | A1 | 9/2009 | Kondo et al. | |

(Continued)

FOREIGN PATENT DOCUMENTS

JP 61 203085 9/1986

(Continued)

OTHER PUBLICATIONS

U.S. Appl. No. 12/810,313, filed Jun. 24, 2010, Kondo, et al.

(Continued)

*Primary Examiner* — Anthony Salata
(74) *Attorney, Agent, or Firm* — Oblon, Spivak, McClelland, Maier & Neustadt, L.L.P.

(57) ABSTRACT

Provided is an elevator apparatus including a first electromagnetic switch and a second electromagnetic switch provided between a first electromagnetic coil and a second electromagnetic coil of a first brake device and a second brake device and a power source. The brake control section includes: a first electromagnetic coil control switch provided between the first electromagnetic coil and a ground section; a second electromagnetic coil control switch provided between the second electromagnetic coil and the ground section; a first processing section for opening and closing the first electromagnetic switch and the first electromagnetic coil control switch in response to a braking operation command issued from an operation control section; and a second processing section for opening and closing the second electromagnetic switch and the second electromagnetic coil control switch in response to the braking operation command.

6 Claims, 3 Drawing Sheets

U.S. PATENT DOCUMENTS

| | | | | |
|---|---|---|---|---|
| 2009/0255764 | A1 | 10/2009 | Ueda et al. | |
| 2009/0283367 | A1 | 11/2009 | Ueda et al. | |
| 2010/0032245 | A1* | 2/2010 | Shibata et al. | 187/288 |
| 2010/0258383 | A1* | 10/2010 | Saarikoski et al. | 187/290 |

FOREIGN PATENT DOCUMENTS

| | | |
|---|---|---|
| JP | 3 3874 | 1/1991 |
| JP | 3 115080 | 5/1991 |
| JP | 3 243576 | 10/1991 |
| JP | 6 219668 | 8/1994 |
| JP | 7 157211 | 6/1995 |
| JP | 8 40658 | 2/1996 |
| JP | 9 221285 | 8/1997 |
| JP | 2001 278572 | 10/2001 |
| JP | 2003 292257 | 10/2003 |

OTHER PUBLICATIONS

U.S. Appl. No. 12/812,609, filed Jul. 13, 2010, Ueda.
U.S. Appl. No. 11/794,198, filed Jun. 26, 2007, Okamoto, et al.
U.S. Appl. No. 11/814,039, filed Jul. 16, 2007, Okamoto, et al.
U.S. Appl. No. 11/794,321, filed Jun. 28, 2007, Shibata, et al.
U.S. Appl. No. 12/593,087, filed Sep. 25, 2009, Hashimoto, et al.
U.S. Appl. No. 12/740,371, filed Apr. 29, 2010, Kondo, et al.

* cited by examiner

ELEVATOR APPARATUS

TECHNICAL FIELD

The present invention relates to an elevator apparatus including a hoisting machine provided with a plurality of brake devices.

BACKGROUND ART

In a conventional braking device for an elevator, two electromagnetic brakes, each including a plunger and a brake coil to individually operate, are used. Even in the case of a failure of one of the electromagnetic brakes, the other electromagnetic brake generates a braking force. Moreover, in order to reduce a speed reduction rate of a car, operation timings of the two plungers are shifted from each other (for example, see Patent Document 1).

Patent Document 1: JP 03-115080 A

DISCLOSURE OF THE INVENTION

Problem to be Solved by the Invention

In the conventional braking device as described above, there is a risk that neither of the two electromagnetic brakes normally operates in the case of a failure of a control section.

The present invention is devised to solve the problem described above, and has an object of providing an elevator apparatus capable of more surely stopping a car even in the case of a failure of a brake control section.

Means for Solving the Problem

An elevator apparatus of the present invention includes:

a car;

suspension means for suspending the car;

a hoisting machine including a drive sheave around which the suspension means is looped, a hoisting machine motor for rotating the drive sheave, and a first brake device and a second brake device for braking rotation of the drive sheave;

an operation control section for controlling raising and lowering of the car by controlling the hoisting machine motor; and a brake control section for controlling operations of the first brake device and the second brake device, in which:

the first brake device includes a first electromagnetic coil for releasing the braking force;

the second brake device includes a second electromagnetic coil for releasing the braking force;

a first electromagnetic switch and a second electromagnetic switch are provided between the first and second electromagnetic coils and a power source; and the brake control section includes:

a first electromagnetic coil control switch provided between the first electromagnetic coil and a ground section;

a second electromagnetic coil control switch provided between the second electromagnetic coil and the ground section;

a first processing section for opening and closing the first electromagnetic switch and the first electromagnetic coil control switch in response to a braking operation command issued from the operation control section; and a second processing section for opening and closing the second electromagnetic switch and the second electromagnetic coil control switch in response to the braking operation command.

BEST MODES FOR CARRYING OUT THE INVENTION

Figure 1:
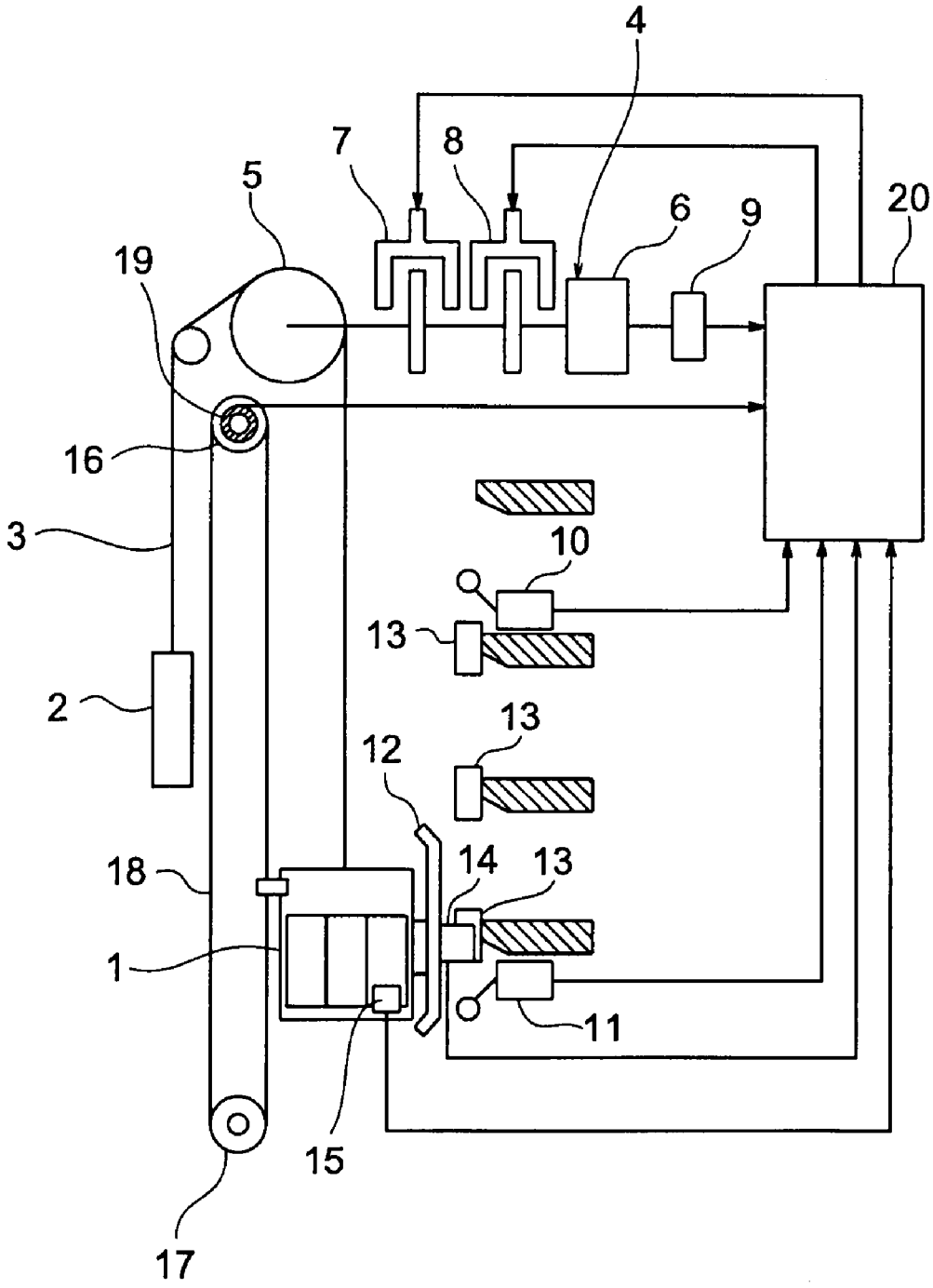
FIG. 1 is a configuration diagram illustrating an elevator apparatus according to a first embodiment of the present invention.

Hereinafter, preferred embodiments of the present invention are described referring to the drawings.

First Embodiment

FIG. 1 is a configuration diagram illustrating an elevator apparatus according to a first embodiment of the present invention. In the drawing, a car 1 and a counterweight 2 are suspended in a hoistway by a main rope 3 corresponding to suspension means, and are raised and lowered in the hoistway by a driving force of a hoisting machine 4.

The hoisting machine 4 includes a drive sheave 5 around which the main rope 3 is looped, a hoisting machine motor 6 for rotating the drive sheave 5, and a first brake device 7 and a second brake device 8 for braking the rotation of the drive sheave 5. Each of the brake devices 7 and 8 includes a brake drum (brake wheel) coupled to the same shaft to which the drive sheave 5 is coupled, a brake shoe to be brought into contact with and separated away from the brake drum, a brake spring for pressing the brake shoe against the brake drum to apply a braking force, and an electromagnetic magnet for separating the brake shoe away from the brake drum against the brake spring to release the braking force.

The hoisting machine motor 6 is provided with a speed detecting section 9 for generating a signal according to a rotation speed of a rotation shaft thereof, that is, a rotation speed of the drive sheave 5. As the speed detecting section 9, for example, an encoder or a resolver is used.

In the vicinity of an upper terminal landing of the hoistway, an upper hoistway switch 10 is provided. In the vicinity of a lower terminal landing of the hoistway, a lower hoistway switch 11 is provided. An operation cam 12 for operating the hoistway switches 10 and 11 is attached to the car 1.

At a position in the hoistway, which corresponds to a door zone (door-openable zone) in the vicinity of each landing door, a detection plate 13 is provided. A door-zone detecting section 14 for detecting the presence/absence of the detection plate 13 to detect that the car 1 is located within the door zone is mounted to the car 1. A door-open detecting section 15 for detecting the opening of a car door corresponding to an elevator door and a landing door is provided to each of the car 1 and landings (only door-open detecting section 15 provided to car 1 is illustrated in FIG. 1).

In an upper portion of the hoistway, an upper pulley 16 is provided. In a lower portion of the hoistway, a lower pulley 17 is provided. An overspeed detection rope 18 is looped around the upper pulley 16 and the lower pulley 17. Both ends of the overspeed detection rope 18 are connected to the car 1. The overspeed detection rope 18 is caused to circulate along with the raising/lowering of the car 1. As a result, the upper pulley 16 and the lower pulley 17 are rotated at a speed according to a running speed of the car 1. An overspeed detecting switch 19 for detecting that the running speed of the car 1 reaches a preset overspeed is provided to the upper pulley 16.

The first brake device 7 and the second brake device 8 are controlled by a brake control section 20. Signals from the speed detecting section 9, the door-zone detecting section 14, and the door-open detecting section 15 are input to the brake control section 20. Moreover, information regarding statuses of the hoistway switches 10 and 11 and the overspeed detecting switch 19 is also input to the brake control section 20. Further, signals according to currents through electromagnetic magnets of the first brake device 7 and the second brake device 8 are also input to the brake control section 20.

The brake control section 20 controls braking forces of the first brake device 7 and the second brake device 8 according to the signal from the speed detecting section 9 and the current signals of the electromagnetic magnets. Moreover, for an emergency stop of the car 1, the brake control section 20 controls the braking forces of the first brake device 7 and the second brake device 8 to prevent a speed reduction rate of the car 1 from being excessively high.

Figure 2:
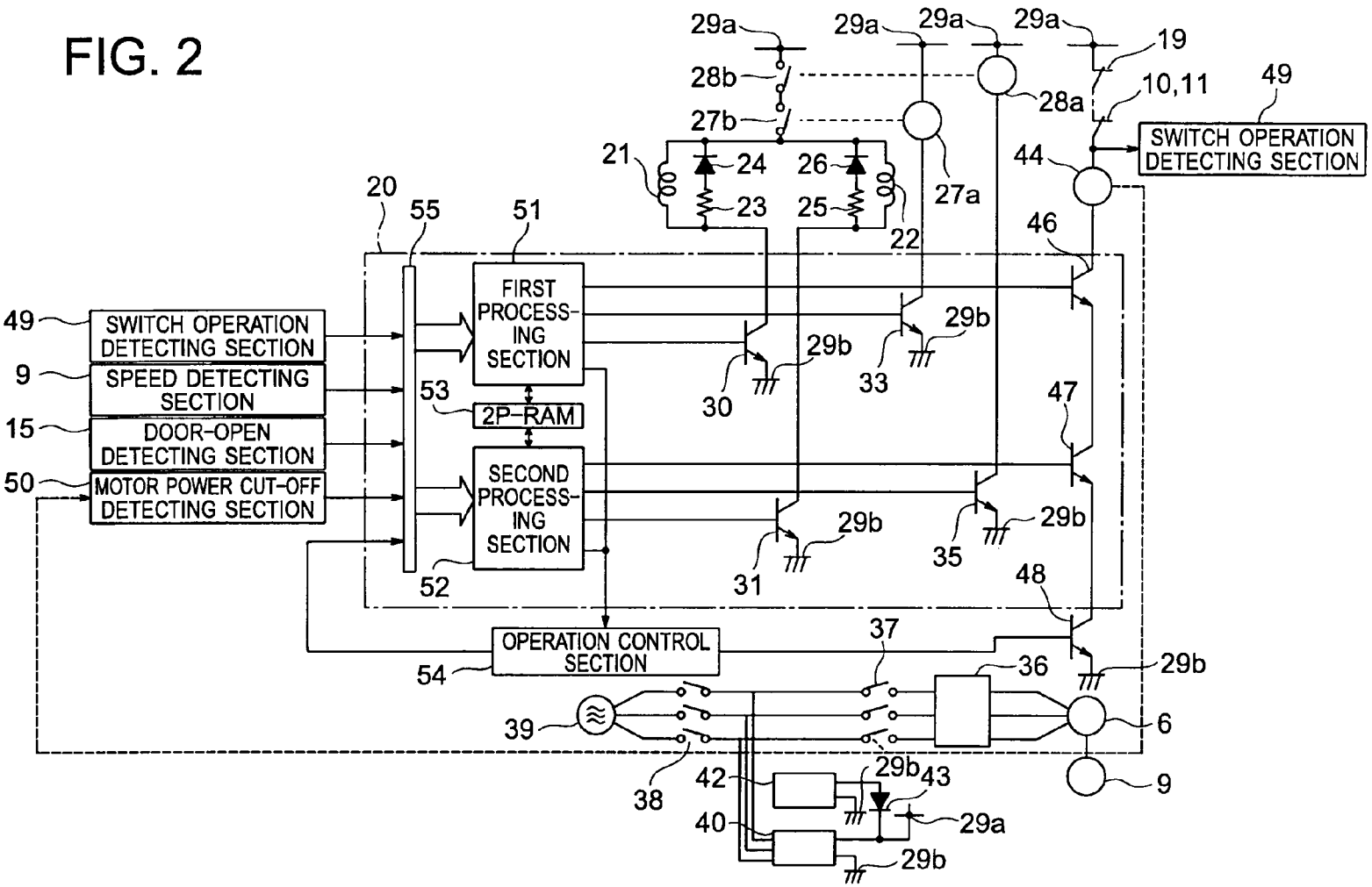
FIG. 2 is a circuit diagram illustrating a principal part of the elevator apparatus illustrated in FIG. 1.

FIG. 2 is a circuit diagram illustrating a principal part of the elevator apparatus illustrated in FIG. 1. In the drawing, a first brake coil 21 corresponding to a first electromagnetic coil is provided to the electromagnetic magnet of the first brake device 7. A second brake coil 22 corresponding to a second electromagnetic coil is provided to the electromagnetic magnet of the second brake device 8.

A circuit obtained by connecting a first discharge resistor 23 and a first discharge diode 24 in series is connected in parallel to the first brake coil 21. A circuit obtained by connecting a second discharge resistor 25 and a second discharge diode 26 in series is connected in parallel to the second brake coil 22.

One end of the first brake coil 21 and one end of the second brake coil 22 are connected to a power source 29*a* through an intermediation of a first electromagnetic switch 27*b* and a second electromagnetic switch 28*b*. The first electromagnetic switch 27*b* and the second electromagnetic switch 28*b* are connected in series. The other end of the first brake coil 21 is connected to a ground section 29*b* of the power source 29*a* through an intermediation of a first semiconductor switch 30 corresponding to a first electromagnetic coil control switch. The other end of the second brake coil 22 is connected to the ground section 29*b* through an intermediation of a second semiconductor switch 31 corresponding to a second electromagnetic coil control switch.

The first electromagnetic switch 27*b* is opened and closed by a first driving coil 27*a*. One end of the first driving coil 27*a* is connected to the power source 29*a*. The other end of the first driving coil 27*a* is connected to the ground section 29*b* through an intermediation of a third semiconductor switch 33 corresponding to a first electromagnetic switch control switch.

The second electromagnetic switch 28*b* is opened and closed by a second driving coil 28*a*. One end of the second driving coil 28*a* is connected to the power source 29*a*. The other end of the second driving coil 28*a* is connected to the ground section 29*b* through an intermediation of a forth semiconductor switch 35 corresponding to a second electromagnetic switch control switch.

The hoisting machine motor 6 is connected to an external power source 39 through an intermediation of an inverter 36, an electromagnetic contactor 37, and a power breaker 38. The power source 29*a* is connected to the external power source 39 through an intermediation of a power converter 40. A three-phase alternating current from the external power source 39 is converted into a direct current by the power converter 40 to be supplied to the power source 29*a*. A battery 42 is also connected to the power source 29*a* through an intermediation of a diode 43. In case of power failure, electric power is supplied from the battery 42 to the power source 29*a*.

Electric power supply to the hoisting machine motor 6 can be cut off by the electromagnetic contactor 37. The electromagnetic contactor 37 is opened and closed by an electromagnetic contactor driving coil 44. One end of the electromagnetic contactor driving coil 44 is connected to the power source 29*a* through an intermediation of the hoistway switches 10 and 11 and the overspeed detecting switch 19. The upper hoistway switch 10, the lower hoistway switch 11, and the overspeed detecting switch 19 are connected in series between the electromagnetic contactor driving coil 44 and the power source 29*a*.

The other end of the electromagnetic contactor driving coil 44 is connected to the ground section 29*b* through an intermediation of a fifth semiconductor switch 46 corresponding to a first contactor control switch, a sixth semiconductor switch 47 corresponding to a second contactor control switch, and a seventh semiconductor switch corresponding to a third contactor control switch. The semiconductor switches 46 to 48 are connected in series between the electromagnetic contactor driving coil 44 and the ground section 29*b*.

Operations of the hoistway switches 10 and 11 and the overspeed detecting switch 19 are detected by a switch operation detecting section 49. An excited state of the electromagnetic contactor driving coil 44, that is, an opened/closed state of the electromagnetic contactor 37 is detected by a motor power cut-off detecting section 50.

Operations of the first, third, and fifth semiconductor switches 30, 33, and 46 are controlled by a first processing section (first computer) 51. Operations of the second, fourth, and sixth semiconductor switches 31, 34, and 47 are controlled by a second processing section (second computer) 52. Each of the first processing section 51 and the second processing section 52 is configured by a microcomputer.

A two-port RAM 53 is connected between the first processing section 51 and the second processing section 52. The first processing section 51 and the second processing section 52 exchange their own data with each other through the two-port RAM 53 to compare the results of computation, thereby detecting a failure occurring in any of the first processing section 51 and the second processing section 52. Upon detection of the failure, a failure detection signal is transmitted from the first processing section 51 and the second processing section to an operation control section 54 for controlling the raising/lowering of the car 1.

The operation control section 54 includes a microcomputer different from the first processing section 51 and the second processing section 52. An operation of the seventh semiconductor switch 48 is controlled by the operation control section 54.

A detection signal from the switch operation detecting section 49, a detection signal from the speed detecting section 9, a detection signal from the door-open detecting section 15, a detection signal from the motor power cut-off detecting section 50, and a brake operation command signal from the operation control section 54 are input to the first processing section 51 and the second processing section 52 through a signal bus 55. The brake control section 20 includes the first processing section 51, the second processing section 52, the two-port RAM 53, the signal bus 55, and the first to sixth semiconductor switches 30, 31, 33, 35, 46, and 47.

Next, an operation is described. The switch operation detecting section 49 detects overrun of the car 1 beyond a range in which the car is raised and lowered or the overspeed thereof. The speed detecting section 9 detects an angle of rotation or a speed of the drive sheave 5. The door-open detecting section 15 detects that any of the car door and the landing doors is opened. The motor power cut-off detecting section 50 operates in cooperation with the electromagnetic contactor 37 to detect the cut-off of the power supply to the hoisting machine motor 6.

The operation control section 54 sends a brake operation command to the brake control section 20 according to the start/stop of the car 1. When the brake operation command is issued, the first processing section 51 and the second processing section 52 turn the third semiconductor switch 33 and the fourth semiconductor switch 35 ON. As a result, the first electromagnetic switch 27*b* and the second electromagnetic switch 28*b* are closed.

The first semiconductor switch 30 and the second semiconductor switch 31 are turned ON/OFF in this state. As a result, the excited states of the first brake coil 21 and the second brake coil 22 are controlled to control the braking states of the first brake device 7 and the second brake device 8. The first processing section 51 and the second processing section 52 apply a control command, for example, a continuous ON/OFF command in accordance with a required current, to the semiconductor switches 30 and 31.

Upon operation of the hoistway switches 10 and 11, the overspeed detecting switch 19, or the seventh semiconductor switch 48, the power supply to the hoisting machine motor 6 is cut off. When the cut-off of the power supply is detected by the motor power cut-off detecting section 50, the first processing section 51 and the second processing section 52 control the currents flowing through the brake coils 21 and 22 by ON/OFF of the semiconductor switches 30 and 31 referring to the signal from the speed detecting section 9 to allow the rotation speed of the drive sheave 5, that is, the speed of the car 1 to follow a target speed pattern. The speed reduction pattern is set to prevent the speed reduction rate from being excessively high.

Moreover, when the speed detected by the speed detecting section 9 is equal to or higher than a preset speed, the first processing section 51 and the second processing section 52 open the electromagnetic switches 27*b* and 28*b* and the electromagnetic contactor 37 to allow the braking forces of the brake devices 7 and 8 to be generated instantaneously without implementing the control for the speed reduction rate.

Further, when the result of computation of the first processing section 51 and the result of computation of the second processing section 52 differ from each other, the difference is probably due to a failure of at least any one of the first processing section 51 and the second processing section 52. Therefore, the electromagnetic switches 27*b* and 28*b* are opened.

In this case, the opening of the electromagnetic switches 27*b* and 28*b* may be set to be after a predetermined time period from the detection of the failure. A time period to the opening of the electromagnetic switches 27*b* and 28*b* is set to a time period required to move the car 1 to an appropriate location, for example, to the nearest floor. Upon input of the failure detection signal to the operation control section 54, the car 1 is moved to the nearest floor by the operation control section 54. After that, the electromagnetic switches 27*b* and 28*b* can be opened. Even if the car 1 cannot be moved to the nearest floor due to some abnormality, the electromagnetic switches 27*b* and 28*b* are opened after the predetermined time period to enable the car 1 to make an emergency stop.

In the elevator apparatus as described above, the brake coils 21 and 22 and the power source 29*a* can be disconnected from each other by the independent processing sections 51 and 52. Therefore, even if the failure of any one of the processing sections 51 and 52 occurs, the brake coils 21 and 22 can be disconnected from the power source 29*a*. Therefore, the car 1 can be more surely stopped.

Moreover, the semiconductor switches 30 and 31 opened and closed by the corresponding processing sections 51 and 52 are provided between the brake coils 21 and 22 and the ground section 29*b*, and hence the currents flowing through the brake coils 21 and 22 can be individually controlled. Moreover, even if the failure of any one of the processing sections 51 and 52 occurs, the current flowing through the brake coil 21 or 22 corresponding to the normal processing section 51 or 52 is still controllable.

Further, when the first processing section 51 and the second processing section 52 detect that the power supply to the hoisting machine motor 6 is cut off, the first processing section and the second processing section control the opening/closing of the first semiconductor switch 30 and the second semiconductor switch 31 to allow the speed of the car 1 to follow the target speed reduction pattern. Therefore, the speed reduction rate of the car 1 at the time of the emergency stop is reduced to reduce the degradation of ride comfort at the time of the emergency stop.

Further, upon detection of the cut-off of the power supply to the hoisting machine motor 6, the first processing section 51 and the second processing section 52 open the first electromagnetic switch 27*b* and the second electromagnetic switch 28*b* when the speed of the car 1 is equal to or higher than the preset speed. Therefore, a stop distance of the car 1 can be prevented from being long.

Moreover, the power source 29*a* for the first brake device 7 and the second brake device 8 and the brake control section 20 is backed up by the battery 42, and hence the braking operation can be more surely performed even in case of power failure.

Second Embodiment

Figure 3:
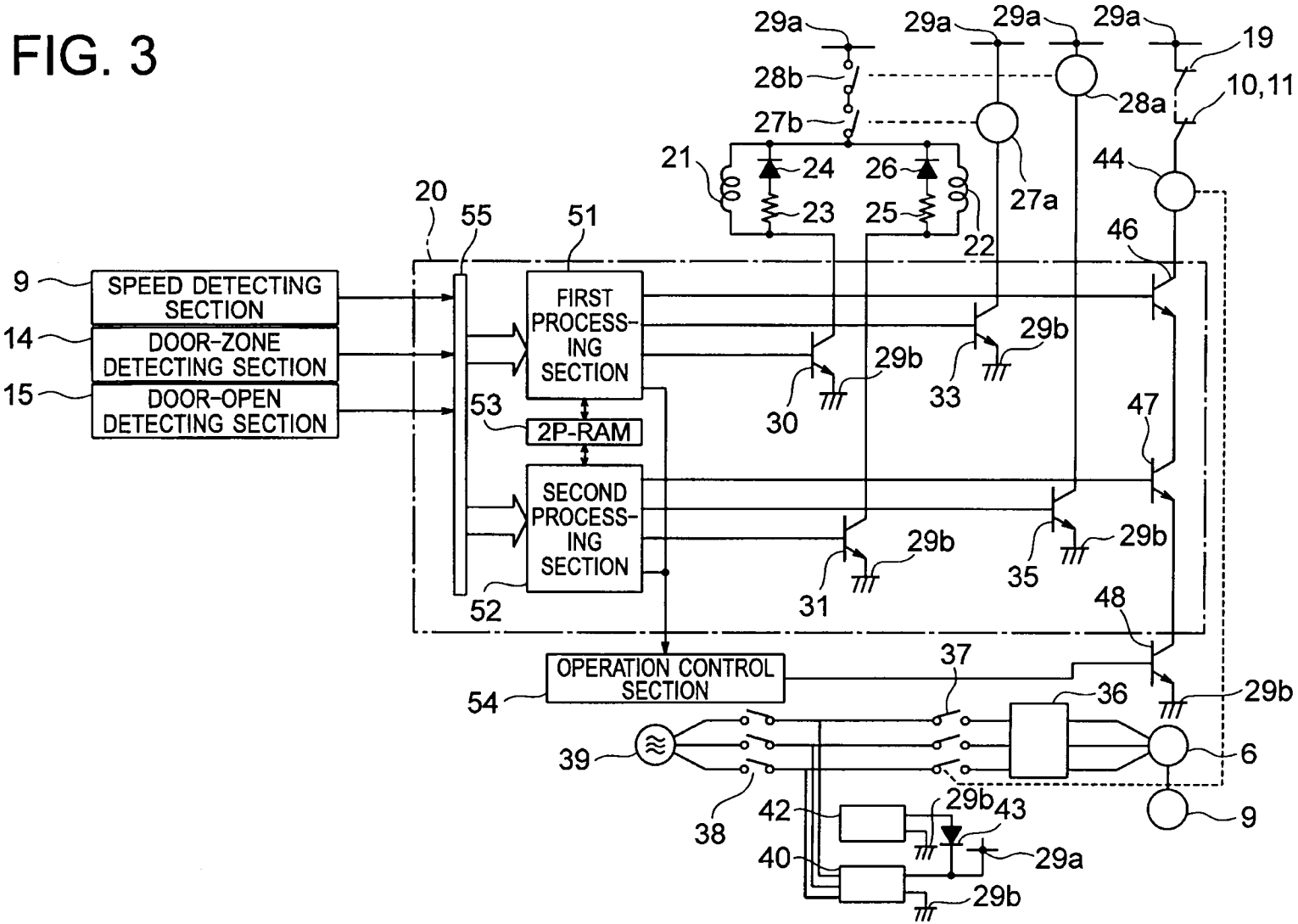
FIG. 3 is a circuit diagram illustrating the principal part of the elevator apparatus according to a second embodiment of the present invention.

Next, FIG. 3 is a circuit diagram illustrating a principal part of the elevator apparatus according to a second embodiment of the present invention. An overall configuration of the elevator apparatus is the same as that illustrated in FIG. 1. In the drawing, the detection signal from the speed detecting section 9, the detection signal from the door-zone detection signal 14, and the detection signal from the door-open detecting section 15 are input to the first processing section 51 and the second processing section 52 through the signal bus 55.

In the case where the opening of any of the car door and the landing doors is detected when the car 1 is located out of the door zone, the first processing section 51 and the second processing section 52 open the fifth semiconductor switch 46 and the sixth semiconductor switch 47.

In the case where the opening of any of the car door and the landing doors is detected when the car 1 is located out of the door zone and the speed of the car 1 is equal to or higher than a preset speed, the first processing section 51 and the second processing section 52 control the opening/closing of the first semiconductor switch 30 and the second semiconductor switch 31 to allow the speed of the car 1 to follow the target speed reduction pattern.

Further, in the case where the opening of any of the car door and the landing doors is detected when the car 1 is located out of the door zone and the speed of the car 1 is less than the preset speed, the first processing section 51 and the second processing section 52 open the first electromagnetic switch 27*b* and the second electromagnetic switch 28*b*. The remaining configuration is the same as that of the first embodiment.

In the elevator apparatus as described above, in the case where the opening of any of the car door and the landing doors is detected when the car 1 is located out of the door zone, the fifth semiconductor switch 46 and the sixth semiconductor switch 47 are opened to de-energize the electromagnetic contactor driving coil 44. Therefore, even in the case of the failure of any one of the first processing section 51 and the second processing section 52, the car 1 can be more surely stopped.

Moreover, in the case where the opening of any of the car door and the landing doors is detected when the car 1 is located out of the door zone and the speed of the car 1 is equal to or higher than the preset speed, the opening/closing of the first semiconductor switch 30 and the second semiconductor switch 31 is controlled to allow the speed of the car 1 to follow the target speed reduction pattern. Therefore, the speed reduction rate of the car 1 at the time of the emergency stop can be reduced to reduce the degradation of ride comfort at the time of emergency stop. However, when the set value of the car speed, for which the control of the speed reduction rate is performed, is a first set value, a second set value higher than the first set value is set, and in case the speed of the car 1 is equal to or higher than the second set value, the electromagnetic switches 27*b* and 28*b* may be immediately opened without performing the control of the speed reduction rate.

Further, in the case where the opening of any of the car door and the landing doors is detected when the car 1 is located out of the door zone and the speed of the car 1 is less than the preset speed, the first electromagnetic switch 27*b* and the second electromagnetic switch 28*b* are opened. Therefore, when the speed of the car 1 is low and therefore the speed reduction rate does not become excessive even if a sudden stop is made, the stop distance can be made minimum.

The number of the brake devices may be three or more. Specifically, the number of the electromagnetic coils or the processing sections may be three or more. In this case, the processing sections and the electromagnetic coils are not necessarily required to correspond to each other in a one-to-one relation.

Moreover, a rope having a circular cross section or a belt-type rope may be used as suspension means.

Further, a plurality of the hoisting machines may be used to raise and lower the single car.

Further, the operation control section and the brake control section may be provided in the same control device or in separate devices.

The invention claimed is:

1. An elevator apparatus comprising:

a car;

suspension means for suspending the car;

a hoisting machine including a drive sheave around which the suspension means is looped, a hoisting machine motor for rotating the drive sheave, and a first brake device and a second brake device for braking rotation of the drive sheave;

an operation control section for controlling raising and lowering of the car by controlling the hoisting machine motor; and a brake control section for controlling operations of the first brake device and the second brake device, wherein:

the first brake device includes a first electromagnetic coil for releasing the braking force;

the second brake device includes a second electromagnetic coil for releasing the braking force;

a first electromagnetic switch and a second electromagnetic switch are provided between the first and second electromagnetic coils and a power source; and the brake control section includes:

a first electromagnetic coil control switch provided between the first electromagnetic coil and a ground section;

a second electromagnetic coil control switch provided between the second electromagnetic coil and the ground section;

a first processing section for opening and closing the first electromagnetic switch and the first electromagnetic coil control switch in response to a braking operation command issued from the operation control section; and a second processing section for opening and closing the second electromagnetic switch and the second electromagnetic coil control switch in response to the braking operation command.

2. The elevator apparatus according to claim 1, further comprising:

an electromagnetic contactor provided between the hoisting machine motor and the power source;

an electromagnetic contactor driving coil for driving the electromagnetic contactor;

an overspeed detecting switch for detecting an overspeed of the car;

hoistway switches for detecting overrun of the car beyond a range in which the car is raised and lowered; and a motor power cut-off detecting section for detecting cut-off of power supply to the hoisting machine motor by the electromagnetic contactor, wherein:

the electromagnetic contactor driving coil, the overspeed detecting switch and the hoistway switches are connected in series between the power source and the ground section; and the first processing section and the second processing section control opening and closing of the first electromagnetic coil switch and the second electromagnetic coil switch so as to allow the speed of the car to follow a target speed reduction pattern when the cut-off of the power supply to the hoisting machine motor is detected.

3. The elevator apparatus according to claim 2, further comprising a speed detecting section for detecting a speed of the car, wherein the first processing section and the second processing section open the first electromagnetic switch and the second electromagnetic switch in a case where the speed of the car is equal to or higher than a preset speed when the cut-off of the power supply to the hoisting machine motor is detected.

4. The elevator apparatus according to claim 1, further comprising:

an electromagnetic contactor provided between the hoisting machine motor and the power source;

an electromagnetic contactor driving coil for driving the electromagnetic contactor;

a door-open detecting section for detecting opening of an elevator door; and a door-zone detecting section for detecting that the car is located within a door zone, wherein:

the brake control section further comprises:

a first contactor control switch to be opened and closed by the first processing section; and a second contactor control switch to be opened and closed by the second processing section;

the first contactor control switch and the second contactor control switch are connected in series to the electromagnetic contactor driving coil between the power source and the ground section; and the first processing section and the second processing section open the first contactor control switch and the second contactor control switch in a case where the opening of the elevator door is detected when the car is located out of the door zone.

5. The elevator apparatus according to claim 4, further comprising a speed detector for detecting a speed of the car, wherein the first processing section and the second processing section control opening and closing of the first electromagnetic coil control switch and the second electromagnetic coil control switch so as to allow the speed of the car to follow a target speed reduction pattern in a case where the opening of the elevator door is detected when the car is located out of the door zone and the speed of the car is equal to or higher than a preset speed.

6. The elevator apparatus according to claim 4, wherein the first processing section and the second processing section open the first electromagnetic switch and the second electromagnetic switch in a case where the opening of the elevator door is detected when the car is located out of the door zone and the speed of the car is less than a preset speed.

* * * * *